US006551113B1

(12) United States Patent
Nishiyama et al.

(10) Patent No.: US 6,551,113 B1
(45) Date of Patent: Apr. 22, 2003

(54) CONNECTOR FOR SIGNAL CHANNEL

(75) Inventors: Takeshi Nishiyama, Kawasaki (JP); Akira Tamura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/536,994

(22) Filed: Mar. 29, 2000

(30) Foreign Application Priority Data

Jul. 2, 1999 (JP) ..... 11-188488

(51) Int. Cl.[7] ..... H01R 13/62
(52) U.S. Cl. ..... 439/67
(58) Field of Search ..... 439/67, 608, 939, 439/941, 947

(56) References Cited

U.S. PATENT DOCUMENTS

| | | | | |
|---|---|---|---|---|
| 3,977,756 A | | 8/1976 | Rodondi | |
| 4,816,789 A | | 3/1989 | Mars | |
| 4,871,315 A | * | 10/1989 | Noschese | 439/67 |
| 5,161,986 A | * | 11/1992 | Gulbranson et al. | 439/67 X |
| 5,741,148 A | * | 4/1998 | Biernath | 439/67 X |
| 6,027,366 A | * | 2/2000 | Mori et al. | 439/67 X |

FOREIGN PATENT DOCUMENTS

| | | |
|---|---|---|
| JP | 52-40767 | 3/1977 |
| JP | 62-295374 | 12/1987 |

* cited by examiner

*Primary Examiner*—Renee Luebke
(74) *Attorney, Agent, or Firm*—Armstrong, Westerman & Hattori, LLP

(57) ABSTRACT

A connector comprises at least a first conductive layer in a first connector half and a plurality of second conductive layers in a second connector half. The second conductive layers are alternated with the first conductive layer when the second connector half is coupled with the first connector half. A plurality of signal lines are arranged between the first and second conductive layers. The first and second conductive layers in combination serve to establish a so-called strip line. Since the first and second conductive layers are adapted to function as ground or shield plates to absorb noise of the respective signal lines, the signal lines can reliably be shielded from noise caused by signals passing through the adjacent signal lines. Accordingly, it is possible to reduce the space between the adjacent signal lines so as to achieve a higher density of the signal lines. In addition, the alternated first and second conductive layers easily achieve a multi-layered structure so as to contribute to an increased number of signal lines.

8 Claims, 10 Drawing Sheets

CONNECTOR FOR SIGNAL CHANNEL

BACKGROUND OF THE INVENTION

1. Field of the Invention

The present invention relates to a connector for establishing a continuous signal channel between a pair of separate signal wires or lines when first and second connector halves are coupled with each other.

2. Description of the Prior Art

Computer systems such as super computer, global servers, UNIX office computers, and the like, in general, allows a CPU (central processing unit) board to exchange electric signals with other boards such as controller boards, memory boards, and the like. Signal channels should be established between the CPU board and the other boards when the signal exchange is realized. Separable connectors are usually employed to connect a signal line of a board to a signal line of another board.

Separable connectors in general employ a pin-socket structure. A pin-socket structure usually comprises a conductive pin protruding from a plug component or first connector half, and a conductive socket embedded within a receptacle component or second connector half. When the plug component is coupled with the receptacle component, the conductive pin is received within the conductive socket. The conductive socket holds the conductive pin by its own elasticity. Such elasticity is supposed to keep a reliable electric connection between the conductive pin and socket.

In recent years, the operating speed or frequency of a CPU has increased, so that a higher transmission rate or frequency is also required for signal or data channels. A higher transmission rate inevitably causes noise to cross over the adjacent signal channels. If the transmission rate is further accelerated in signal or data channels, reaching a level over 1 or more GHz, for example, a severe countermeasure is required to prevent noise form crossing over adjacent signal or data channels.

In addition, signal channels should face a demand of a higher density in the future. However, a further reduction in size or dimension is hardly achieved in the aforementioned pin-socket structure. A smaller conductive socket cannot establish an elasticity enough to hold a conductive pin within the conductive socket itself. Less elasticity may induce, for example, a failure in an electric connection between the conductive socket and the conductive pin.

SUMMARY OF INVENTION

It is accordingly an object of the present invention to provide a connector, for establishing a signal or data channel, capable of meeting the demand of a higher transmission rate and a higher density of signal channels without any difficulty.

According to a first aspect of the present invention, there is provided a connector for a signal channel, comprising: at least a first conductive layer in a first connector half, a plurality of second conductive layers in a second connector half, to be alternated with the first conductive layer when the second connector half is coupled with the first connector half, and a plurality of signal lines arranged between the first and second conductive layers.

With the above structure, the first and second conductive layers, in combination, serve to establish a so-called strip line. Since the first and second conductive layers are adapted to function as ground or shield plates to absorb noise of the respective signal lines, the signal lines can reliably be shielded from noise caused by signals passing through the adjacent signal lines. Accordingly, it is possible to reduce the space between the adjacent signal lines so as to achieve a higher density of the signal lines. In addition, the alternated first and second conductive layers easily achieve a multilayered structure so as to contribute to an increased number of signal lines.

The connector may further comprise a conductive wire disposed between the adjacent signal lines. The conductive wire serves to, in combination with the first and second conductive layers, surround the signal line so as to provide a structure similar to coaxial cable. Accordingly, the signal lines can be tightly shielded from noise caused by signals passing through the adjacent signal lines.

In place of the conductive wire, a conductive wall may be employed to connect the first and second conductive layers to each other between the adjacent signal lines. The conductive wall likewise serves to, in combination with the first and second conductive layers, completely surround the signal line so as to provide a true coaxial cable. Accordingly, the signal lines can be completely shielded from noise caused by signals passing through the adjacent signal lines.

According to a second aspect of the present invention, there is provided a connector for a signal channel, comprising: at least a first conductive layer in a first connector half; a first flexible insulation layer superposed on a surface of the first conductive layer; first signal lines extending on a surface of the first flexible insulation layer; at least a second conductive layer in a second connector half; a second flexible insulation layer superposed on a surface of the second conductive layer, the second flexible insulation layer being spaced from the first flexible insulation layer between the first and second conductive layers when the first and second connector halves are coupled with each other; and second signal lines extending on a surface of the second insulation layer, the second signal lines being connected to the corresponding first signal lines between the first and second connector halves are coupled with each other.

A flexible circuit board comprising the first flexible insulation layer and the first signal lines as well as a flexible circuit board comprising the second flexible insulation layer and the second signal lines may be employed to provide a so-called strip line. In the aforementioned manner, the first and second signal lines between the first and second conductive layers can reliably be shielded from noise caused by signals passing through the adjacent first and second signal lines. In addition, the alternated first and second conductive layers easily achieve a multilayered structure so as to contribute to an increased number of the first and second signal lines. Moreover, employment of the flexible circuit board also serves to prevent variation in electric characters such as a contact resistance and the like to the utmost.

In addition, the connector may further comprise: first conductive pads formed at tip ends of the first signal lines and located along a datum line intersecting, by a predetermined inclination angle, a lateral direction perpendicular to a longitudinal direction of the first signal lines; and second conductive pads formed at tip ends of the second signal lines, which extend on extensions of the first signal lines when the first and second connector halves are coupled with each other, and located along the datum line. With such a structure, the first and second connector halves can be coupled with or detached from each other, not only along the longitudinal directions of the first and second signal lines, but also along the lateral directions, perpendicular to the longitudinal directions, of the first and second signal lines.

Alternatively, the connector may further comprise: first conductive pads formed at tip ends of the first signal lines and located along a datum line intersecting, by a predetermined inclination angle, a lateral direction perpendicular to a longitudinal direction of the first signal lines; and second conductive pads formed at tip ends of the second signal lines, which extend across the first signal lines so as to reach the datum line when the first and second connector halves are coupled with each other, and located along the datum line. In the case where the first and second signal lines are designed to intersect each other by a predetermined inclination angle when the first and second connector halves are coupled with each other, the respective combinations of the first and second signal lines, connected to each other, may be designed to extend over a predetermined length. The length of the signal channels, each comprising the combination of the first and second signal lines, can be unified in the connector. Such a structure may contribute to avoidance of skews between the signal channels.

In order to keep a reliable contact between the first and second signal lines, the connector may further comprise a leaf spring interposed between the surface of the first conductive layer and the first flexible insulation layer so as to establish an elastic force for urging the first signal lines toward the second signal lines when the first and second connector halves are coupled with each other. Such a leaf spring may serve to keep enough contact pressure even when mechanical characters, such as the width and/or thickness, of the first and second signal lines are varied. The connector may accept variation in an electric character, such as a contact resistance, of the first and second signal lines without losing a reliable contact between the first and second signal lines.

In place of the aforementioned leaf spring, a common holding mechanism may be employed to keep together the first and second conductive layers, which are alternately superposed, when the first and second connector halves are coupled with each other. The common holding mechanism likewise allows the connector to accept variation in an electric character of the first and second signal lines without losing a reliable contact between the first and second signal lines. Moreover, the common holding mechanism may contribute to simplification of the structure of the connector even when an increased number of first and second conductive layers and/or the first and second signal lines are required in the connector.

The aforementioned connector may employ a connector half comprising: at least a conductive layer; a pair of flexible insulation layers superposed on opposite surfaces of the conductive layer; and a plurality of signal lines extending on surfaces of the respective flexible insulation layers. In addition, the connector may employ, in combination with the above connector half, a connector half comprising: a housing; at least a pair of conductive layers spaced each other within the housing; a pair of flexible insulation layers superposed on surfaces of the conductive layers facing each other; and a plurality of signal lines extending on surfaces of the flexible insulation layers.

BRIEF DESCRIPTION OF THE DRAWINGS

The above and other objects, features and advantages of the present invention will become apparent from the following description of the preferred embodiments in conjunction with the accompanying drawings, wherein.

DESCRIPTION OF THE PREFERRED EMBODIMENTS

Figure 1A:
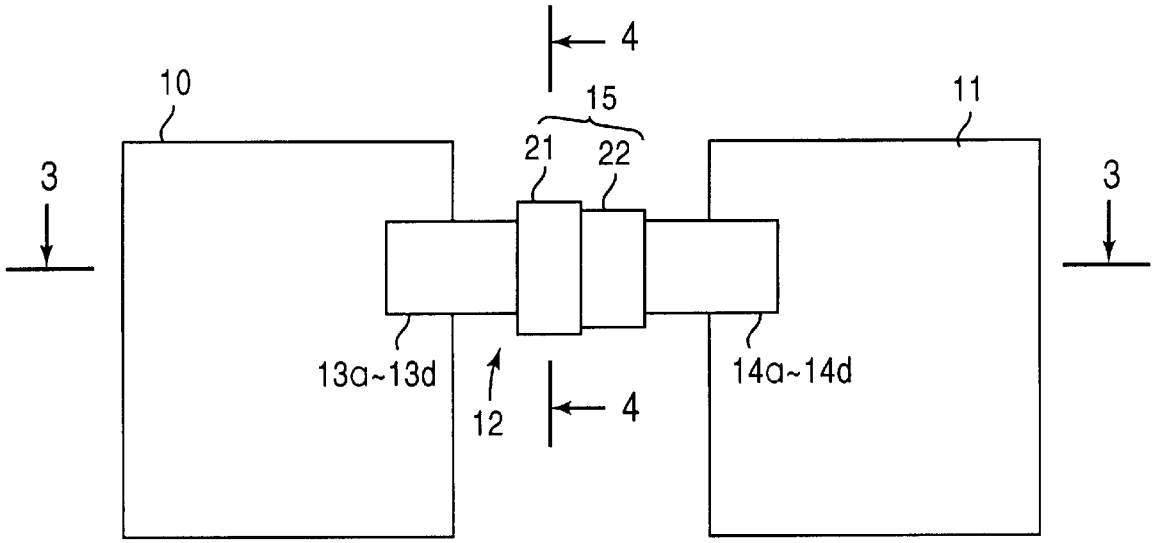
FIG. 1A schematically illustrates a plan view of a CPU (central processing unit) board and a circuit board connected to each other through a cable assembly, while FIG. 1B schematically illustrates a side view thereof.
Figure 1B:
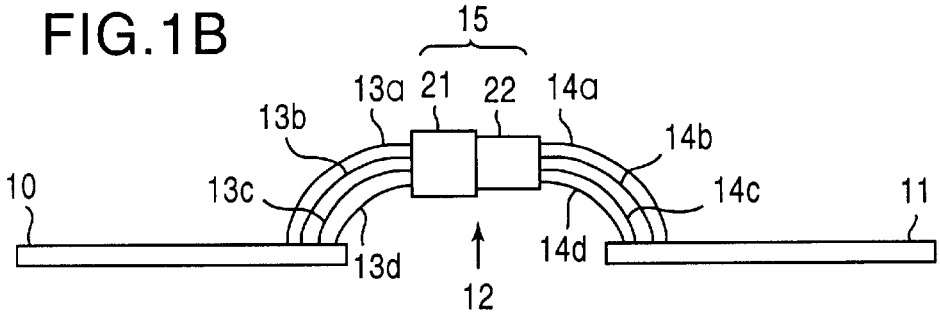
Figure 2:
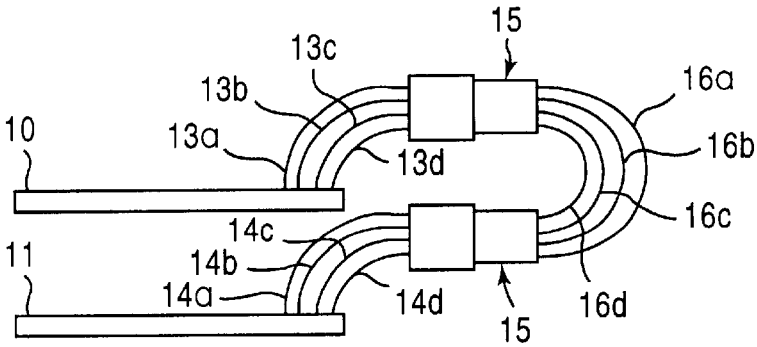
FIG. 2 is a side view schematically illustrating a CPU board and a circuit board connected to each other through additional or supplemental cables.

A computer system such as a super computer, a global server, or a UNIX office computer comprises, as shown in FIG. 1A and FIG. 1B, a CPU (central processing unit) board 10 on which a CPU is mounted, and a circuit board 11 such as a controller board or memory board. Cable assembly 12 is interposed between the CPU board 10 and the circuit board 11 for establishing signal or data channels between the CPU board 10 and the circuit board 11. The cable assembly 12 includes one or more first flexible printed circuit boards 13*a*–13*d* fixedly mounted on the CPU board 10, and one or more second flexible printed circuit boards 14*a*–14*d* likewise mounted on the circuit board 11. A separable connector 15 is employed to connect the first and second flexible printed circuit boards 13*a*–13*d*, 14*a*–14*d*. Otherwise, additional or supplemental cables 16*a*–16*d* comprising flexible printed circuit boards may be employed to establish connection between the first and second flexible printed circuit boards 13*a*–13*d*, 14*a*–14*d*, as shown in FIG. 2, for example. In this case, separable connectors 15 are likewise interposed between the first flexible printed circuit boards 13*a*–13*d* and the cables 16*a*–16*d* and between the second flexible printed circuit boards 14*a*–14*d* and the cables 16*a*–16*d*.

Figure 3:
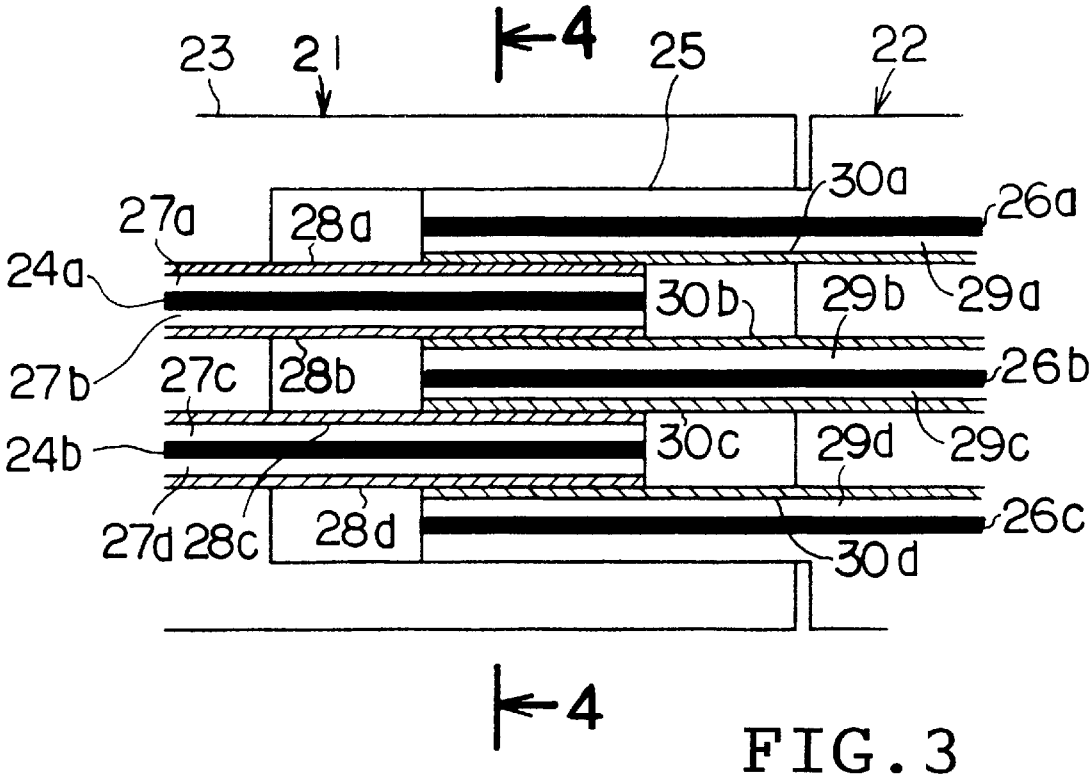
FIG. 3 is an enlarged sectional view, taken along the line 3—3 in FIG. 1A, illustrating in part a separable connector.

The separable connector 15 comprises a first or plug component 21 and a second or receptacle component 22. The plug and receptacle components 21, 22 can be detachably coupled with each other. The plug component 21 comprises, as shown in FIG. 3, one or more first conductive layers or plates 24*a*, 24*b* fixed within a housing 23 made from a synthetic resin material. On the other hand, the receptacle component 22 comprises two or more spaced second conductive layers or plates 26*a*–26*c* likewise fixed within a housing 25 made from a synthetic resin material. When the housing 23 of the plug component 21 is received within the housing 25 of the receptacle component 22, the first conductive plates 24*a*, 24*b* are held between the adjacent second conductive plates 26*a*–26*c*. Accordingly, the second conductive plates 26*a*–26*c* are alternated with the first conductive plates 24*a*, 24*b* when the housing 25 is coupled with the housing 23.

Figure 4:
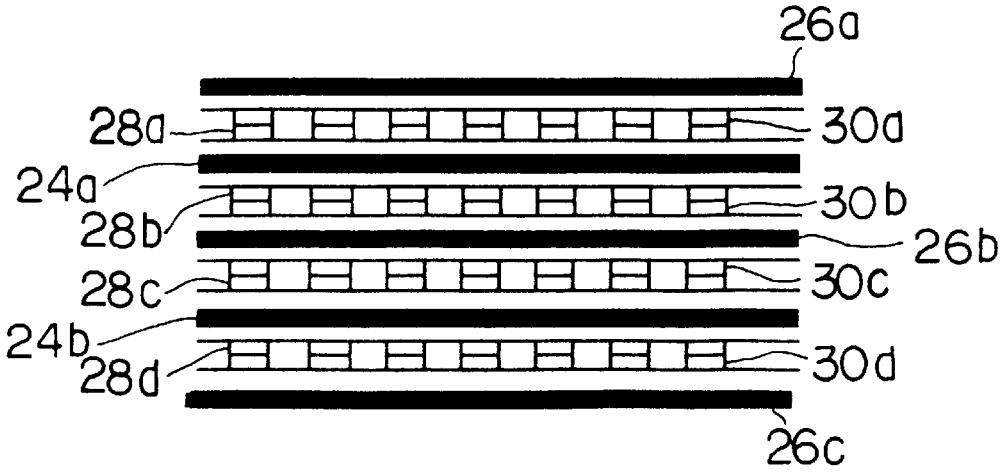
FIG. 4 is a sectional view taken along the lines 4—4 in FIGS. 1A and 3.

Flexible insulation layers or films 27*a*, 27*b* of the first flexible printed circuit boards 13*a*, 13*b* are fixedly superposed on the opposite surfaces of the first conductive plate 24*a*. Likewise, flexible insulation layers or films 27*c*, 27*d* of the first flexible printed circuit boards 13*c*, 13*d* are fixedly superposed on the opposite surfaces of the first conductive plate 24*b*. Referring also to FIG. 4, stripes of first signal lines or printed wires 28*a*–28*d* extend in parallel on the exposed surfaces of the respective flexible insulation films 27*a*–27*d*. The adjacent signal lines 28*a*–28*d* may be spaced by a constant interval.

A referring again to FIG. 3, flexible insulation layers or films 29*a*, 29*b* of the second flexible printed circuit boards 14*a*, 14*b* are fixedly superposed on the second conductive plates 26*a*, 26*b* at the surfaces facing each other. As is apparent from FIG. 4, stripes of second signal lines or printed wires 30*a*, 30*b* extend in parallel on the exposed surfaces of the respective flexible insulation films 29*a*, 29*b*. When the plug and receptacle components 21, 22 are coupled with each other, the first conductive plates 24*a* is inserted between the second conductive plates 26*a*, 26*b*. The flexible insulation film 27*a* of the first flexible printed circuit board 13*a* is allowed to face the flexible insulation film 29*a* of the second flexible printed circuit board 14*a*, while the flexible insulation film 27*b* of the first flexible printed circuit board 13*b* is allowed to face the flexible insulation film 29*b* of the second flexible printed circuit board 14*b*. The first signal lines 28*a*, 28*b* are electrically connected to the second signal lines 30*a*, 30*b*, one by one, between the flexible insulation films 27*a*, 29*a* facing each other and between the flexible insulation films 27*b*, 29*b* facing each other.

In the same manner, flexible insulation layers or films 29*c*, 29*d* of the second flexible printed circuit boards 14*c*, 14*d* are fixedly superposed on the second conductive plates 26*b*, 26*c* at the surfaces facing each other. As is apparent from FIG. 4, stripes of second signal lines or printed wires 30*c*, 30*d* extend in parallel on the exposed surfaces of the respective flexible insulation films 29*c*, 29*d*. When the plug and receptacle components 21, 22 are coupled with each other, the first conductive plates 24*b* is inserted between the second conductive plates 26*b*, 26*c*. The flexible insulation film 27*c* of the first flexible printed circuit board 13*c* is allowed to face the flexible insulation film 29*c* of the second flexible printed circuit board 14*c*, while the flexible insulation film 27*d* of the first flexible printed circuit board 13*d* is allowed to face the flexible insulation film 29*d* of the second flexible printed circuit board 14*d*. The first signal lines 28*c*, 28*d* are electrically connected to the second signal lines 30*c*, 30*d*, one by one, between the flexible insulation films 27*c*, 29*c* facing each other and between the flexible insulation films 27*d*, 29*d* facing each other.

As shown in FIG. 4, the separable connector 15 allows the first and second signal lines 28*a*–28*d*, 30*a*–30*d* to be connected to each other between the adjacent conductive plates 26*a*, 24*a*, 26*b*, 24*b*, 26*c*. So-called strip lines can be established in the separable connector 15. Accordingly, noise of the respective signal lines 28*a*–28*d*, 30*a*–30*d* can be absorbed by the first and second conductive plates 24*a*, 24*b*, 26*a*–26*c*, namely, ground plates, so that the first and second signal lines 28*a*–28*d*, 30*a*–30*d* can reliably be shielded from noise caused by signals passing through the adjacent first and second signal lines 28*a*–28*d*, 30*a*–30*d*.

Figure 5:
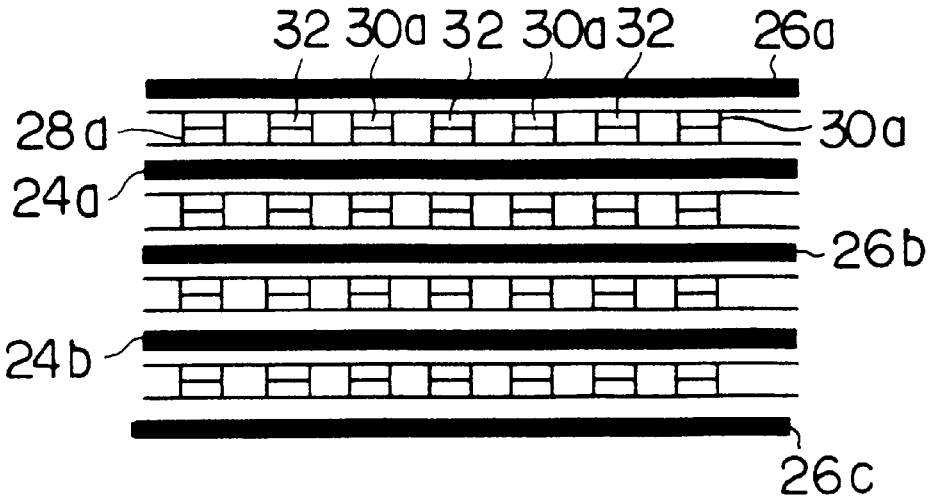
FIG. 5 is an enlarged sectional view, corresponding to FIG. 4, illustrating in part a separable connector according to another specific embodiment.

As shown in FIG. 5, for example, conductive or ground wires 32 may be disposed between the adjacent first and second signal lines 28*a*–28*d*, 30*a*–30*d* on the surfaces of the respective flexible insulation films 27*a*–27*d*, 29*a*–29*d* in the separable connector 15. The adjacent conductive wires 32 serve to, in combination with the first and second conductive plates 24*a*, 24*b*, 26*a*–26*c*, surround the respective first and second signal lines 28*a*–28*d*, 30*a*–30*d* so as to provide a structure similar to a coaxial cable. Accordingly, the first and second signal lines 28*a*–28*d*, 30*a*–30*d* can much tightly be shielded from noise caused by signals passing through the adjacent first and second signal lines 28*a*–28*d*, 30*a*–30*d*.

Figure 6:
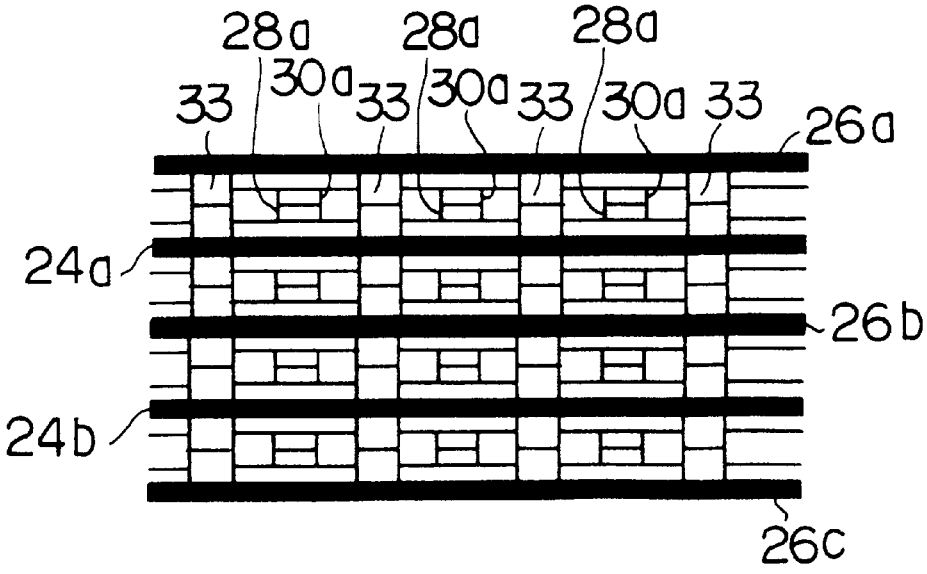
FIG. 6 is an enlarged sectional view, corresponding to FIG. 4, illustrating in part a separable connector according to further specific embodiment.

Otherwise, as shown in FIG. 6, conductive walls 33 may be disposed between the adjacent first and second signal lines 28*a*–28*d*, 30*a*–30*d* in the separable connector 15. The conductive walls 33 stand upright on the surface of the first and second conductive plates 24*a*, 24*b*, 26*a*–26*c* so as to connect the first and second conductive plate 24*a*, 24*b*, 26*a*–26*c* to each other, for example. The adjacent conductive walls 33 serve to, in combination with the first and second conductive plates 24*a*, 24*b*, 26*a*–26*c*, completely surround the respective first and second signal lines 28*a*–28*d*, 30*a*–30*d* so as to provide a structure identical to a coaxial cable. Accordingly, the first and second signal lines 28*a*–28*d*, 30*a*–30*d* can completely be shielded from noise caused by signals passing through the adjacent first and second signal lines 28*a*–28*d*, 30*a*–30*d*. A via may be formed in the flexible insulation films 27*a*–27*d*, 29*a*–29*d* so as to provide the conductive wall 33.

Figure 7:
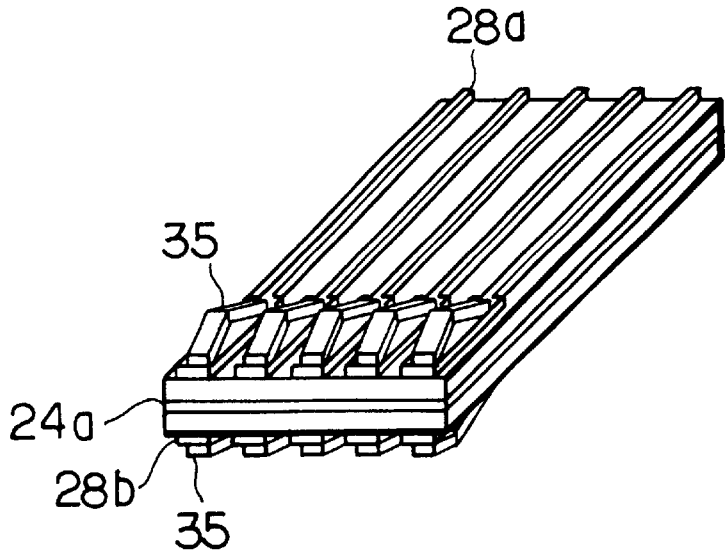
FIG. 7 is a perspective view schematically illustrating the structure of a first conductive plate according to a specific example.
Figure 8:
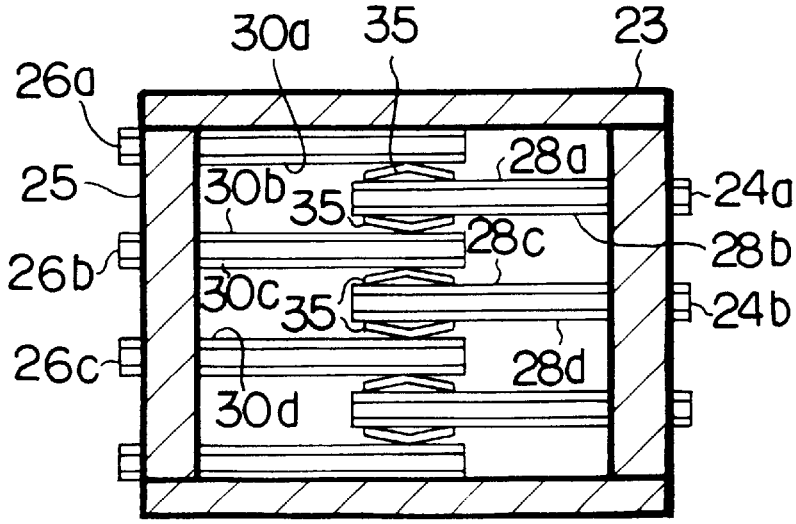
FIG. 8 is a partial sectional view schematically illustrating the connection between the plug and receptacle components in which the first conductive plate of FIG. 7 is assembled.

The aforementioned separable connector 15 may, as shown in FIG. 7, employ conductive elastic member or leaf springs 35 attached to the first signal lines 28*a*–28*d* at the tip ends for achieving a reliable contact between the first and second signal lines 28*a*–28*d*, 30*a*–30*d*. For example, a solder, a conductive adhesive, and the like, may be employed to fix the leaf springs 35 to the first signal lines 28*a*–28*d*. The leaf springs 35 serve to, as shown in FIG. 8, keep a reliable contact between the first and second signal lines 28*a*–28*d*, 30*a*–30*d*. The first and second signal lines 28*a*–28*d*, 30*a*–30*d* can be prevented from suffering from a failure in electric connection.

Figure 9:
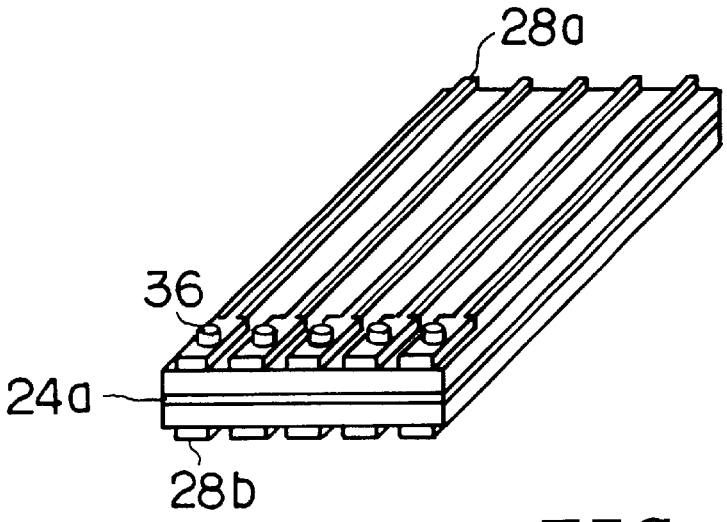
FIG. 9 is a perspective view schematically illustrating the structure of a first conductive plate according to another specific example.

The leaf springs 35 may be replaced, as shown in FIG. 9, with conductive bumps or protrusions 36 integrally formed at the tip ends of the first signal lines 28*a*–28*d*, for example. The bumps 36 likewise serve to reliably hold the contact between the first and second signal lines 28*a*–28*d*, 30*a*–30*d*.

The first and second signal lines 28*a*–28*d*, 30*a*–30*d* can also be prevented from suffering from a failure in electric connection. It should be noted that the leaf springs 35 or the bumps 36 may be attached or formed on the second signal lines 30*a*–30*d* in place of the first signal lines 28*a*–28*d*. At least either of the first and second signal lines 28*a*–28*d*, 30*a*–30*d* should be provided with the leaf springs 35 or the conductive bumps 36.

Figure 10:
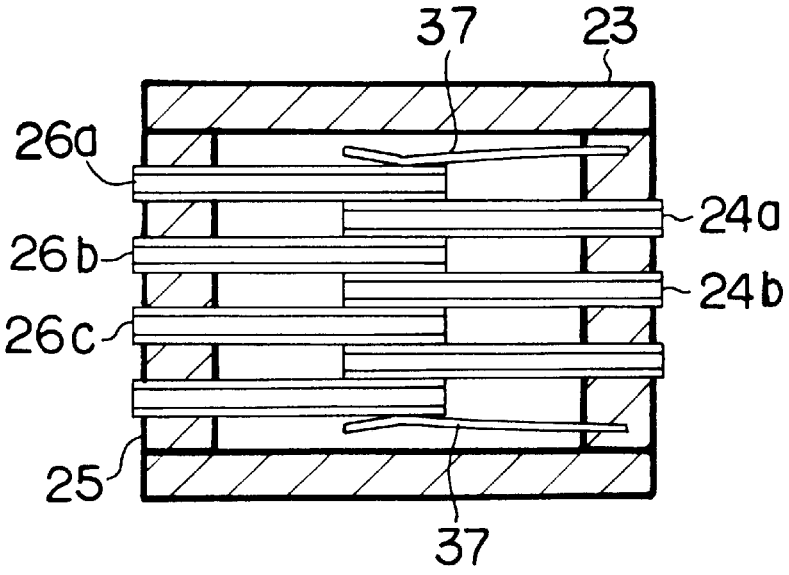
FIG. 10 is a partial sectional view schematically illustrating the structure of a common holding mechanism according to a specific example.

Otherwise, as shown in FIG. 10, a common holding mechanism comprising leaf springs 37 may be employed to reliably hold the contact between the first and second signal lines 28*a*–28*d*, 30*a*–30*d*. The leaf springs 37 serve to commonly hold the alternate first and second conductive plates 24*a*, 24*b*, 26*a*–26*c* therebetween. The leaf springs 37 may be attached to the housings 23, 25 of the plug and receptacle components 21, 22, for example.

Figure 11:
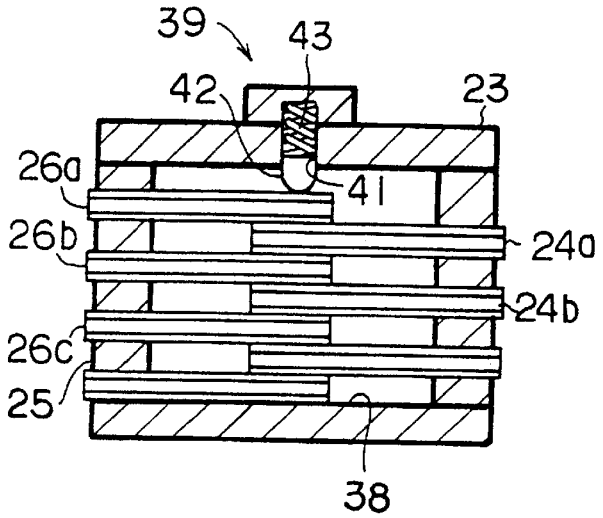
FIG. 11 is a partial sectional view schematically illustrating the structure of a common holding mechanism according to another specific example.

Also, as shown in FIG. 11, a common holding mechanism may employ a pressing or biasing mechanism 39 in place of the leaf springs 37, to commonly bias or urge the alternate first and second conductive plates 24*a*, 24*b*, 26*a*–26*c* against a stationary plane 38. The stationary plane 38 may be defined on the inner surface of the housing 23, 25 of the plug or receptacle component 21, 22. The first and second conductive plates 24*a*, 24*b*, 26*a*–26*c* can reliably be held between the stationary plane 38 and the biasing mechanism 39. The biasing mechanism 39 may comprise, for example, a receiving hole 41 formed in the housing 23, and a piston member 42 received in the receiving hole 41. In this case, a spring 43 is interposed between the piston member 42 and the receiving hole 41 for biasing the piston member 42 so as to protrude the piston member 42 out of the receiving hole 41.

The common holding mechanism such as the leaf springs 37 and biasing mechanism 39 may be employed to simplify the structure of the separable connector 15 even when an increased number of first and second conductive plates 24*a*, 24*b*, 26*a*–26*c* and first and second signal lines 28*a*–28*d*, 30*a*–30*d* are to be provided in the separable connector 15. In addition, such a common holding mechanism allows the separable connector 15 to accept variation in an electric character such as a contact resistance without losing a reliable contact between the first and second signal lines 28*a*–28*d*, 30*a*–30*d*. In general, when a contact resistance is to be changed, the size such as thickness and/or width of the signal lines 28*a*–28*d*, 30*a*–30*d* should be changed. Such change in size may induce variation in mechanical character of the signal lines 28*a*–28*d*, 30*a*–30*d*, for example, reduction in elasticity, given to the signal lines 28*a*–28*d*, 30*a*–30*d*. The aforementioned common holding mechanism is supposed to keep the contact between the signal lines 28*a*–28*d*, 30*a*–30*d* even when the signal lines 28*a*–28*d*, 30*a*–30*d* fail to have an elasticity enough to hold the contact between the signal lines 28*a*–28*d*, 30*a*–30*d* by themselves.

Figure 12:
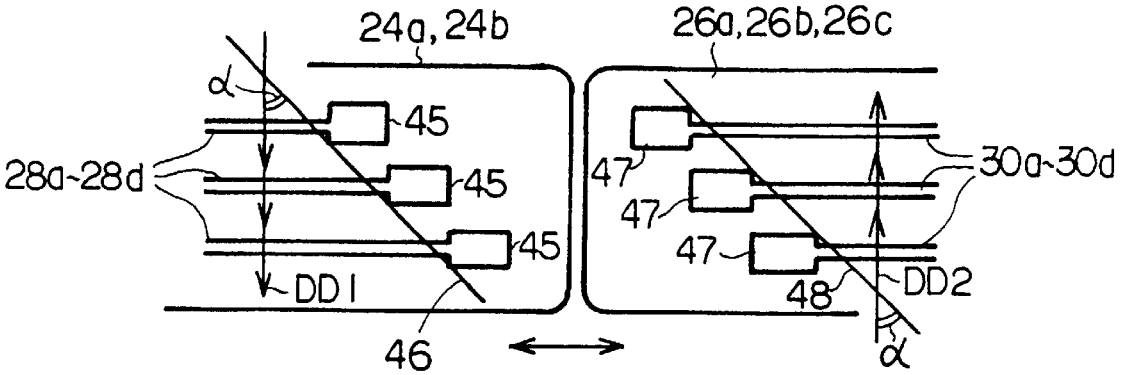
FIG. 12 is a plan view illustrating the location of first and second conductive pads formed at the tip ends of first and second signal lines, respectively, according to a specific embodiment.

Furthermore, as shown in FIG. 12, first conductive pads 45 may be formed at the tip ends of the first signal lines 28*a*–28*d* in the aforementioned separable connector 15. The first conductive pads 45 are located along a datum line 46 intersecting by a predetermined inclination angle $\alpha$ the lateral direction DD1 perpendicular to the longitudinal direction of the first signal lines 28*a*–28*d*. Likewise, the second conductive pads 47 may be formed at the tip ends of the second signal lines 30*a*–30*d*. The second conductive pads 47 are located along a datum line 48 intersecting by the inclination angle $\alpha$ the lateral direction DD2 perpendicular to the longitudinal direction of the second signal lines 30*a*–30*d* in the same manner.

Figure 13:
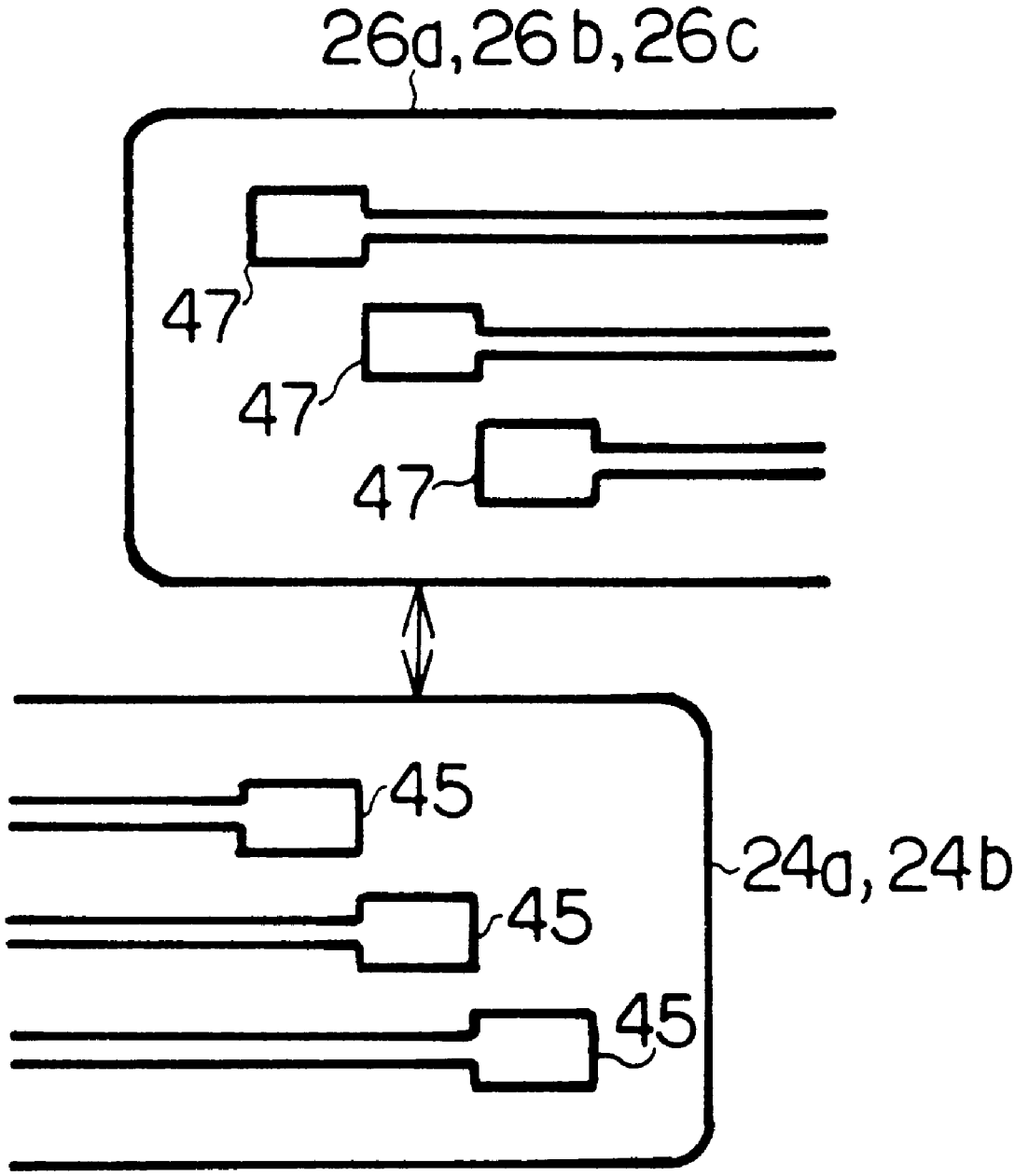
FIG. 13 is a plan view illustrating plug and receptacle components when coupled with each other in the lateral direction.

When the plug and receptacle components 21, 22 are coupled with each other, the second signal lines 30*a*–30*d* should be positioned to extend on extensions of the first signal lines 28*a*–28*d*. If the datum lines 46, 48 are aligned with each other, the respective second conductive pads 47 are reliably allowed to individually contact with the corresponding first conductive pads 45. In this case, the plug and receptacle components 21, 22 can be coupled with or detached from each other, not only along the longitudinal directions of the first and second signal lines 28*a*–28*d*, 30*a*–30*d* as shown in FIG. 12, but also along the lateral directions DD1, DD2 of the first and second signal lines 28*a*–28*d*, 30*a*–30*d* as shown in FIG. 13.

Figure 14:
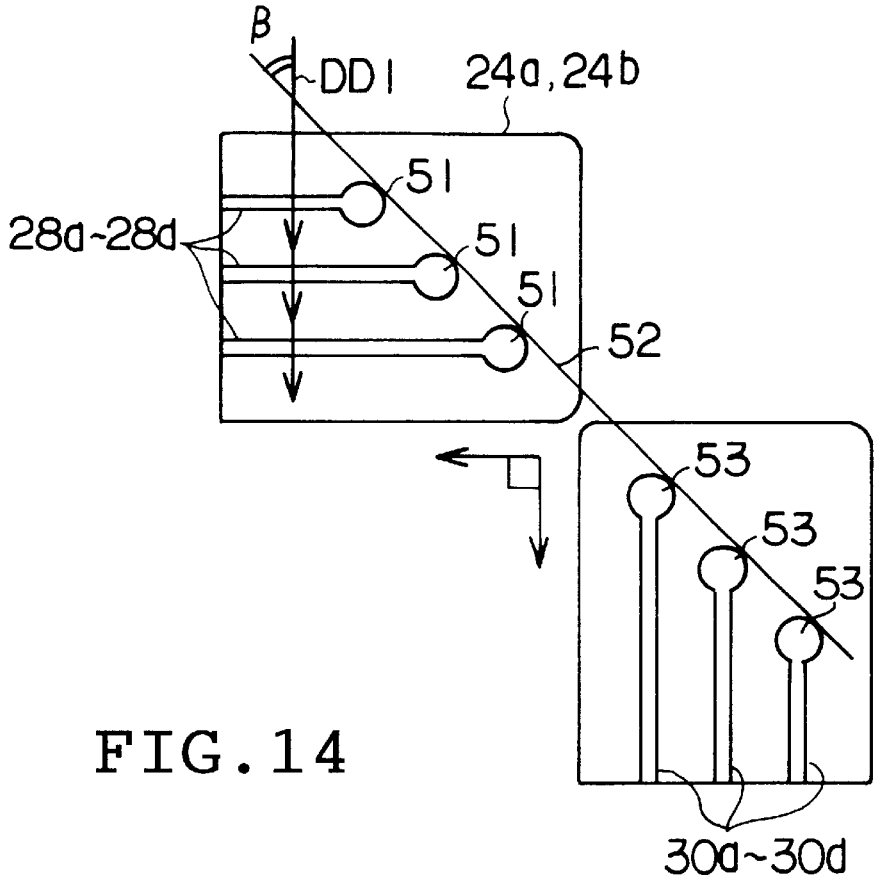
FIG. 14 is a plan view illustrating the location of first and second conductive pads formed at the tip ends of first and second signal lines, respectively, according to another embodiment.

The first and second signal lines 28*a*–28*d*, 30*a*–30*d* may, not only extend along a single line or direction but also intersect each other by a predetermined angle. As shown in FIG. 14, the first conductive pads 51 formed at the tip ends of the first signal lines 28*a*–28*d* may be located along a datum line 52 intersecting by a predetermined inclination angle $\beta$ the lateral direction DD1 perpendicular to the longitudinal direction of the first signal lines 28*a*–28*d* in the aforementioned manner. On the other hand, second conductive pads 53 may be formed at the tip ends of the second signal lines 30*a*–30*d* so as to correspond to the respective first conductive pads 51. In this case, the second signal lines 30*a*–30*d* is allowed to extend across the first signal lines 28*a*–28*d* so as to reach the datum line 52 when the plug and receptacle components 21, 22 are coupled with each other.

Figure 15:
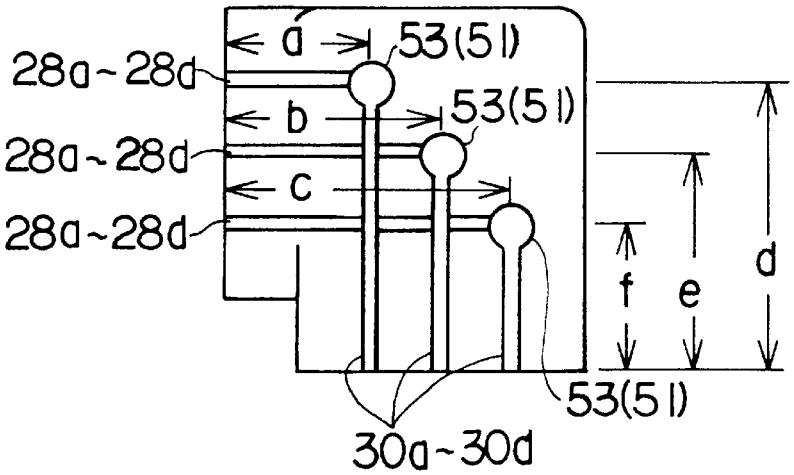
FIG. 15 is a plan view illustrating plug and receptacle components when coupled with each other.

The length a, b, a of the first signal lines 28*a*–28*d* and the length d, e, f of the second signal lines 30*a*–30*d* can be adjusted in this separable connector 15. The combinations of length a+d, b+e, c+f can be set constant so as to establish signal paths of the identical length as shown in FIG. 15. It is possible to avoid skew between the signal paths each comprising the combination of the first and second signal lines 28*a*–28*d*, 30*a*–30*d*. In this case, at least either one of the first and second signal lines 28*a*–28*d*, 30*a*–30*d* may be covered with an insulation layer or film on the surface of the flexible insulation films 27*a*–27*d*, 29*a*–29*d*. Such an insulation layer serves to avoid an electric connection between the first and second signal lines 28*a*–28*d*, 30*a*–30*d* even when the second signal lines 30*a*–30*d* extend across the first signal lines 28*a*–28*d*. The second signal lines 30*a*–30*d* need not intersect the first signal lines 28*a*–28*d* by right angles.

Figure 16:
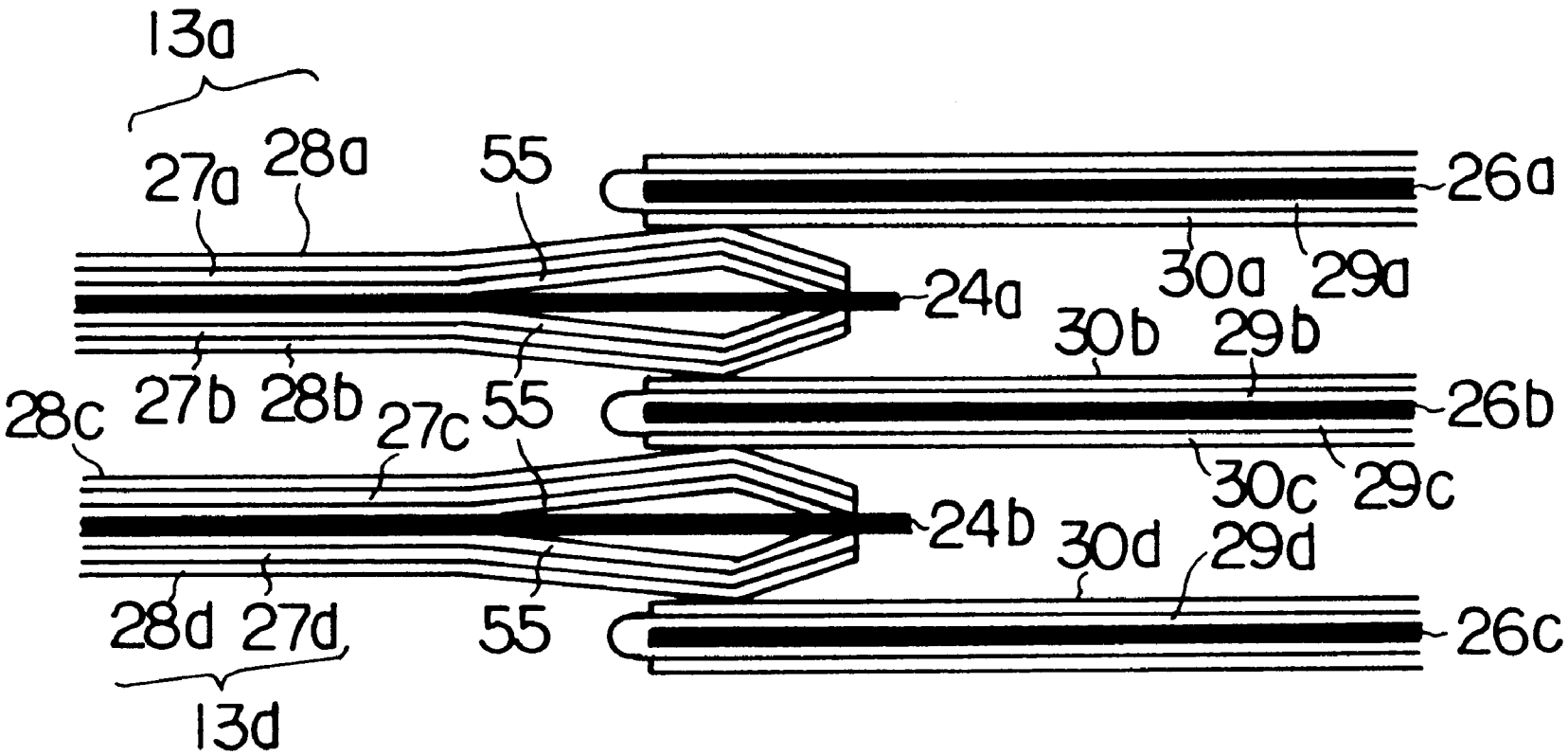
FIG. 16 is an enlarged sectional view schematically illustrating in part a separable connector according to another embodiment.

FIG. 16 illustrates a separable connector 15 according to another embodiment of the present invention. Leaf springs 55 are interposed between the surfaces of the first conductive plates 24*a*, 24*b* and the first flexible printed circuit boards 13*a*–13*d*, namely, the first flexible insulation films 27*a*–27*d* in this separable connector 15. The leaf springs 55 serve to establish an elastic force for urging the first signal lines 28*a*–28*d* against the corresponding second signal lines 30*a*–30*d* when the plug and receptacle components 21, 22 are coupled with each other. The elastic force serves to hold contact between the first and second signal lines 28*a*–28*d*, 30*a*–30*d*. The lead springs 55 may establish a reliable contact between the first and second signal lines 28*a*–28*d*, 30*a*–30*d* irrespective of variation in size such as thickness and/or width of the first and/or second signal lines 28*a*–28*d*, 30*a*–30*d*. The separable connector 15 in this manner can accept variation in an electric character such as a contact resistance of the first and second signal lines 28*a*–28*d*, 30*a*–30*d* without losing a reliable contact between the first and second signal lines 28*a*–28*d*, 30*a*–30*d*.

Figure 17:
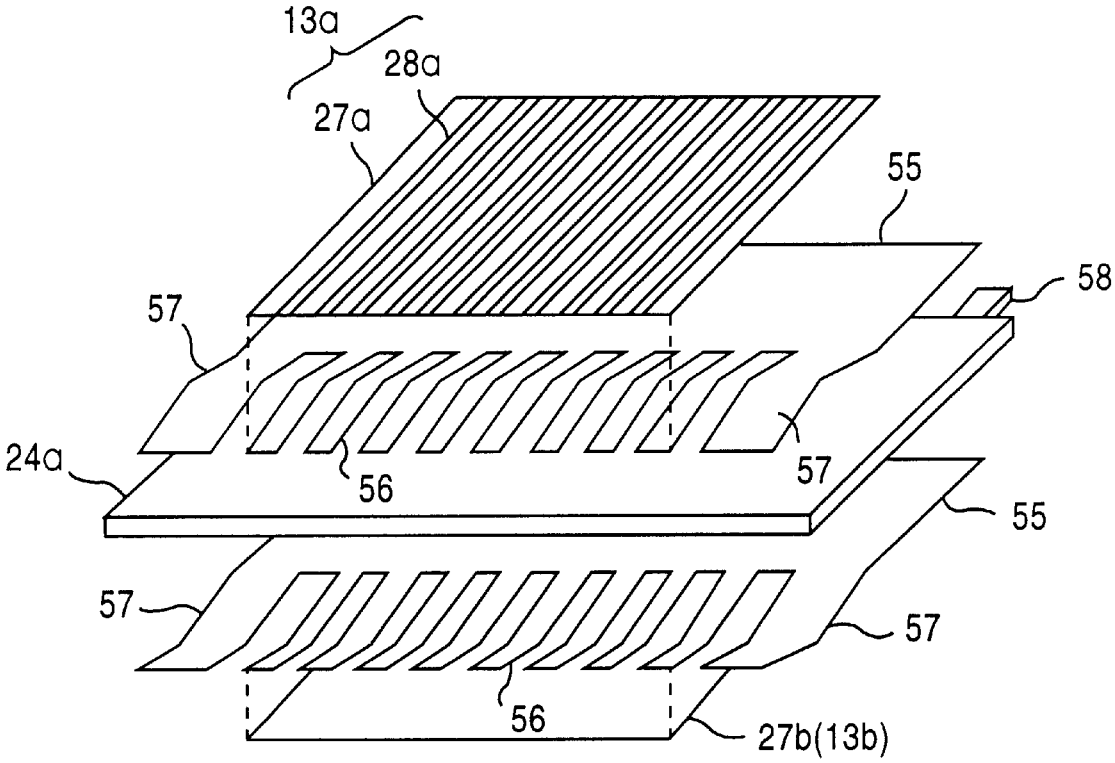
FIG. 17 is an exploded perspective view schematically illustrating the structure of a plug component.

Next, a description will be made on a method of making the plug component 21 according to this embodiment. As shown in FIG. 17, the first conductive plate 24*a* is punched out of a phosphor bronze plate, for example. The phosphor bronze plate may have a thickness of approximately 0.2 mm.

The leaf springs 55 are adhered on the opposite surfaces of the first conductive plate 24*a*. An adhesive may be employed in attachment. The leaf springs 55 may be shaped out of a beryllium copper plate having a thickness of approximately 0.2 mm, for example. The tip ends are folded to have an elasticity or biasing force. Slits 56 can be used to adjust or reduce the magnitude of the biasing force. Larger or wider slits 56 result in a smaller biasing force of the leaf spring 55.

The first flexible printed circuit boards 13*a*, 13*b* are fixedly superposed on the surfaces of the leaf springs 55. The first conductive plate 24*a* with the first flexible printed circuit boards 13*a*, 13*b* is embedded in the housing 23 of the plug component 21. Another first conductive plate 24*b* is likewise embedded in the housing 23, along with the first printed circuit boards 13*c*, 13*d* and the leaf springs 55, in parallel with the first conductive plate 24*a*. It should be noted that the housing 23 may receive more than three first conductive plates.

In this case, a pair of contact portions 57 may be formed by the leaf spring 55 at the opposite ends in the lateral direction, as clearly shown in FIG. 17. The contact portions 57 are designed to contact the surface of the opposed second conductive plates 26*a*, 26*b* when the first conductive plate 24*a* is inserted between the adjacent second conductive plates 26*a*, 26*b*. Since electric connection can be established between the contact portions 57 and the first conductive plate 24*a*, the contact portions 57 allow the first and second conductive plates 24*a*, 26*a*, 26*b* to also establish electric connection therebetween. Noise generated from the signal lines 28*a*–28*d*, 30*a*–30*d* is allowed to spread all over the first and second conductive plates 24*a*, 26*a*, 26*b*. Such release of noise may contribute to a further reliability to prevent the noise from crossing over the adjacent signal lines 28*a*–28*d*, 30*a*–30*d*.

Furthermore, a connection terminal 58 may be formed at the rear end of the first conductive plate 24*a* for contacting a printed ground pattern, not shown, formed on the surface of the CPU board 10 and/or the other circuit board 11 when the plug component 21 is mounted on the CPU and/or circuit boards 10, 11. Such release of noise to the printed ground pattern from the plug component 21 may contribute to a still further reliability to prevent the noise from crossing over the adjacent signal lines 28*a*–28*d*, 30*a*–30*d* in the plug component 21. In the same manner, such connection terminal 58 may be formed at the rear end of the second conductive plates 26*a*–26*c*.

What is claimed is:

1. A connector for establishing a signal channel, comprising:

at least a first conductive plate in a first connector half;

first insulation layers superposed over front and back surfaces of the first conductive plate, respectively;

first printed signal lines extending on exposed surfaces of the first insulation layers;

at least a pair of second conductive plates in a second connector half, to be alternated with the first conductive plate when the second connector half is coupled with the first connector half;

second insulation layers superposed over the second conductive plates, respectively, on surfaces opposed to the front and back surfaces of the first conductive plate;

second printed signal lines extending on exposed surfaces of the second insulation layers, the second printed signal lines being correspondingly connected to the first printed signal lines between the first and second insulation layers when the first and second connector halves are coupled with each other; and conductive printed ground lines disposed between adjacent ones of the first printed signal lines and between adjacent ones of the second printed signal lines such that the first and second signal lines are shielded from noise caused by signals passing through adjacent first and second signal lines.

2. The connector according to claim 1, further comprising a common holding mechanism keeping together the first and second conductive plates, which are alternately superposed, when the first and second connector halves are coupled with each other.

3. A connector for establishing a signal channel, comprising:

at least a first conductive plate in a first connector half;

first insulation layers superposed over front and back surfaces of the first conductive plate, respectively;

first printed signal lines extending on exposed surfaces of the first insulation layers;

at least a pair of second conductive plates in a second connector half, to be alternated with the first conductive plate when the second connector half is coupled with the first connector half;

second insulation layers superposed over the second conductive plates, respectively, on surfaces opposed to the front and back surfaces of the first conductive plate;

second printed signal lines extending on exposed surfaces of the second insulation layers, the second printed signal lines being correspondingly connected to the first printed signal lines between the first and second insulation layers when the first and second connector halves are coupled with each other; and first conductive walls standing from the first conductive plate between adjacent ones of the first printed signal lines; and second conductive walls standing from the second conductive plates between adjacent ones of the second printed signal lines; wherein said second conductive walls are coupled to corresponding ones of the first conductive walls for connecting the first conductive plate to the second conductive plates, respectively, when the first and second connector halves are coupled with each other.

4. A connector for establishing a signal channel, comprising:

at least a first conductive plate in a first connector half;

first insulation layers superposed over front and back surfaces of the first conductive plate, respectively;

first printed signal lines extending on exposed surfaces of the first insulation layers;

at least a pair of second conductive plates in a second connector half, to be alternated with the first conductive plate when the second connector half is coupled with the first connector half;

second insulation layers superposed over the second conductive plates, respectively, on surfaces opposed to the front and back surfaces of the first conductive plate;

second printed signal lines extending on exposed surfaces of the second insulation layers, the second printed signal lines being correspondingly connected to the first printed signal lines between the first and second insulation layers when the first and second connector halves are coupled with each other;

first conductive pads formed at tip ends of the first printed signal lines and located along a datum line intersecting, by a predetermined inclination angle other than 0, a lateral direction perpendicular to a longitudinal direction of the first printed signal lines; and second conductive pads formed at tip ends of the second printed signal lines, which extend on extensions of the first printed signal lines when the first and second connector halves are coupled with each other, and located along the datum line.

5. A connector for establishing a signal channel, comprising:

at least a first conductive plate in a first connector half;

first insulation layers superposed over front and back surfaces of the first conductive plate, respectively;

first printed signal lines extending on exposed surfaces of the first insulation layers;

at least a pair of second conductive plates in a second connector half, to be alternated with the first conductive plate when the second connector half is coupled with the first connector half;

second insulation layers superposed over the second conductive plates, respectively, on surfaces opposed to the front and back surfaces of the first conductive plate;

second printed signal lines extending on exposed surfaces of the second insulation layers, the second printed signal lines being correspondingly connected to the first printed signal lines between the first and second insulation layers when the first and second connector halves are coupled with each other;

first conductive pads formed at tip ends of the first printed signal lines and located along a datum line intersecting, by a predetermined inclination angle other than 0, a lateral direction perpendicular to a longitudinal direction of the first printed signal lines; and second conductive pads formed at tip ends of the second printed signal lines, which extend across the first printed signal lines so as to reach the datum line when the first and second connector halves are coupled with each other, and located along the datum line.

6. A connector for establishing a signal channel, comprising:

at least a first conductive plate in a first connector half;

first insulation layers superposed over front and back surfaces of the first conductive plate, respectively;

first printed signal lines extending on exposed surfaces of the first insulation layers;

at least a pair of second conductive plates in a second connector half, to be alternated with the first conductive plate when the second connector half is coupled with the first connector half;

second insulation layers superposed over the second conductive plates, respectively, on surfaces opposed to the front and back surfaces of the first conductive plate;

second printed signal lines extending on exposed surfaces of the second insulation layers, the second printed signal lines being correspondingly connected to the first printed signal lines between the first and second insulation layers when the first and second connector halves are coupled with each other; and leaf springs interposed between the front and back surfaces of the first conductive plate and the first insulation layers, respectively, so as to establish an elastic force for urging the first insulation layers toward corresponding ones of the second insulation layers for connecting the first printed signal lines with the second printed signal lines when the first and second connector halves are coupled with each other.

7. A connector half comprising:

at least an electrically conductive plate;

a pair of flexible insulation layers superposed on front and back surfaces of the conductive plate;

a plurality of printed signal lines extending on exposed surfaces of the respective flexible insulation layers, tip ends of the printed signal lines ending at a periphery of the front and back surfaces of the conductive plate; and conductive printed ground lines disposed between adjacent ones of the printed signal lines such that the signal lines are shielded from noise caused by signals passing through adjacent signal lines.

8. A connector half comprising:

a housing;

at least a pair of conductive plates spaced from each other within the housing;

a pair of flexible insulation layers superposed over the conductive plates on surfaces facing each other;

a plurality of printed signal lines extending on exposed surfaces of the flexible insulation layers; and conductive printed ground lines disposed between adjacent ones of the printed signal lines such that the signal lines are shielded from noise caused by signals passing through adjacent signal lines.

* * * * *